US010326238B2

(12) United States Patent
Wahl et al.

(10) Patent No.: US 10,326,238 B2
(45) Date of Patent: Jun. 18, 2019

(54) SYSTEMS AND DEVICES FOR MAINTAINING AN ELECTRICAL CONNECTION

(71) Applicant: Microsoft Technology Licensing, LLC, Redmond, WA (US)

(72) Inventors: James David Wahl, Woodinville, WA (US); Spencer Bo Eggert, Redmond, WA (US); Suet Fong Tin, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 2 days.

(21) Appl. No.: 15/268,206

(22) Filed: Sep. 16, 2016

(65) Prior Publication Data

US 2018/0083388 A1 Mar. 22, 2018

(51) Int. Cl.

| | |
|---|---|
| ***H01R 13/633*** | (2006.01) |
| ***H01R 13/58*** | (2006.01) |
| *H01R 13/20* | (2006.01) |
| *H01R 13/627* | (2006.01) |
| *H01R 24/62* | (2011.01) |
| *H01R 13/436* | (2006.01) |

(Continued)

(52) U.S. Cl.

CPC ..... *H01R 13/6335* (2013.01); *H01R 13/5825* (2013.01); *H01R 13/633* (2013.01); *H01R 13/20* (2013.01); *H01R 13/4361* (2013.01); *H01R 13/5845* (2013.01); *H01R 13/629* (2013.01); *H01R 13/6271* (2013.01); *H01R 13/6275* (2013.01); *H01R 13/639* (2013.01); *H01R 24/22* (2013.01); *H01R 24/62* (2013.01); *H01R 2103/00* (2013.01)

(58) Field of Classification Search

CPC ..... H01R 24/62; H01R 13/629; H01R 13/20; H01R 13/639; H01R 13/4361; H01R 13/6271; H01R 13/6275; H01R 13/6335

USPC ..... 439/344, 483, 345, 346, 347, 352

See application file for complete search history.

(56) References Cited

U.S. PATENT DOCUMENTS

| | | | |
|---|---|---|---|
| 7,674,120 | B2 | 3/2010 | Morganstern et al. |
| 8,342,862 | B2 | 1/2013 | Konersmann et al. |

(Continued)

FOREIGN PATENT DOCUMENTS

| | | | |
|---|---|---|---|
| EP | 1744408 | A1 | 1/2007 |
| EP | 3024096 | A1 | 5/2016 |

(Continued)

OTHER PUBLICATIONS

"Bee-Line High Performance Connectors", Retrieved Date: Jun. 16, 2016 Available at: http://www.powerandsignal.com/docs/Products/beeline.pdf.

(Continued)

*Primary Examiner* — Abdullah A Riyami
*Assistant Examiner* — Justin M Kratt
(74) *Attorney, Agent, or Firm* — Ray Quinney & Nebeker P.C.; Paul N. Taylor

(57) ABSTRACT

An electrical connector includes a locking plug, a lock actuator, a strain relief, and an exterior mating surface. The locking plug includes a locking mechanism and the lock actuator is coupled to the locking mechanism. The strain relief is coupled to the locking plug and the exterior mating surface is coupled to the locking plug and axially moveable relative to the locking plug to move the lock actuator.

20 Claims, 16 Drawing Sheets

(51) Int. Cl.

| | |
|---|---|
| *H01R 13/629* | (2006.01) |
| *H01R 13/639* | (2006.01) |
| *H01R 103/00* | (2006.01) |
| *H01R 24/22* | (2011.01) |

(56) References Cited

U.S. PATENT DOCUMENTS

| | | | | |
|---|---|---|---|---|
| 9,071,019 | B2 | 6/2015 | Burris et al. | |
| 2011/0223785 | A1 | 9/2011 | Jiang et al. | |
| 2014/0227897 | A1 | 8/2014 | Chang | |
| 2015/0104967 | A1 | 4/2015 | Jaan et al. | |
| 2017/0279221 | A1* | 9/2017 | Toh | H01R 13/6272 |

FOREIGN PATENT DOCUMENTS

| | | | |
|---|---|---|---|
| GB | 2436900 | A | 10/2007 |
| WO | 9909612 | A1 | 2/1999 |

OTHER PUBLICATIONS

"International Search Report and Written Opinion Issued in PCT Application No. PCT/US2017/051037", dated Nov. 7, 2017, 12 Pages.

* cited by examiner

SYSTEMS AND DEVICES FOR MAINTAINING AN ELECTRICAL CONNECTION

BACKGROUND

Background and Relevant Art

Use of computing devices is becoming more ubiquitous by the day. Computing devices range from standard desktop computers to wearable computing technology and beyond. One area of computing devices that has grown in recent years is the hybrid computers. Hybrid computers may act as a both a conventional computer with conventional user interaction devices, such as a keyboard, a mouse, a trackpad, trackball, stylus, or other input peripherals, as well as a touch-sensitive computing device that allows for direct interaction with information by a user's input on the display device.

Hybrid computers, therefore, experience more movement than conventional computers. The movement of the computer introduces additional challenges to electrical connections from a reliability standpoint, a power continuity standpoint, and a safety standpoint. Conventional electrical connectors rely upon friction fits that may loosen during movement of the device, or rely upon mechanical locking methods that are difficult to engage and disengage in the restrictive spaces behind the devices. In addition to difficulty of use, the conventional mechanical locking methods are disruptive to the Industrial Design.

The subject matter claimed herein is not limited to implementations that solve any disadvantages or that operate only in environments such as those described above. Rather, this background is only provided to illustrate one exemplary technology area where some implementations described herein may be practiced.

BRIEF SUMMARY

In an implementation, an electrical connector includes a locking plug, a lock actuator, a strain relief, and an exterior mating surface. The locking plug includes a locking mechanism and the lock actuator is coupled to the locking mechanism. The strain relief is coupled to the locking plug and the exterior mating surface is coupled to the locking plug and axially moveable relative to the locking plug to move the lock actuator.

In another implementation, an electrical connector includes an electrical plug, a cable, and an exterior mating surface, a biasing element, and a strain relief. The cable is in electrical communication with the electrical plug. The exterior mating surface is moveable in an axial direction relative to the electrical plug. The biasing element is configured to bias the exterior mating surface axially toward the electrical plug. The strain relief is positioned circumferentially about the cable.

In yet another implementation, a system for making an electrical connection includes an electronic device having an appliance inlet connector and an appliance coupler connector configured to engage with the appliance inlet connector. The appliance inlet connector has an appliance inlet connector surface. The appliance coupler connector includes an electrical plug, a strain relief, and an exterior mating surface. The strain relief is coupled to the electrical plug. The exterior mating surface is coupled to the electrical plug and moveable in an axial direction relative to the electrical plug. The exterior mating surface is biased toward the appliance inlet connector surface. The exterior mating surface has a shoulder abutting the appliance inlet connector surface in a plugged configuration.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which.

DETAILED DESCRIPTION

This disclosure generally relates to electrical connection apparatuses, systems, and methods. More particularly, this disclosure generally relates to locking apparatuses, systems, and methods for securing computing devices.

An electrical connection includes a positive terminal, a negative terminal, and a ground terminal. The electrical connection includes an appliance inlet connector and an appliance coupler connector that mate together to provide electrical communication. A plurality of prongs of the appliance inlet connector is received in a plurality of receivers in the appliance coupler connector. In some implementations, at least one of receivers of the plurality of receivers includes a locking mechanism to lock the prong in the receiver.

Figure 1:
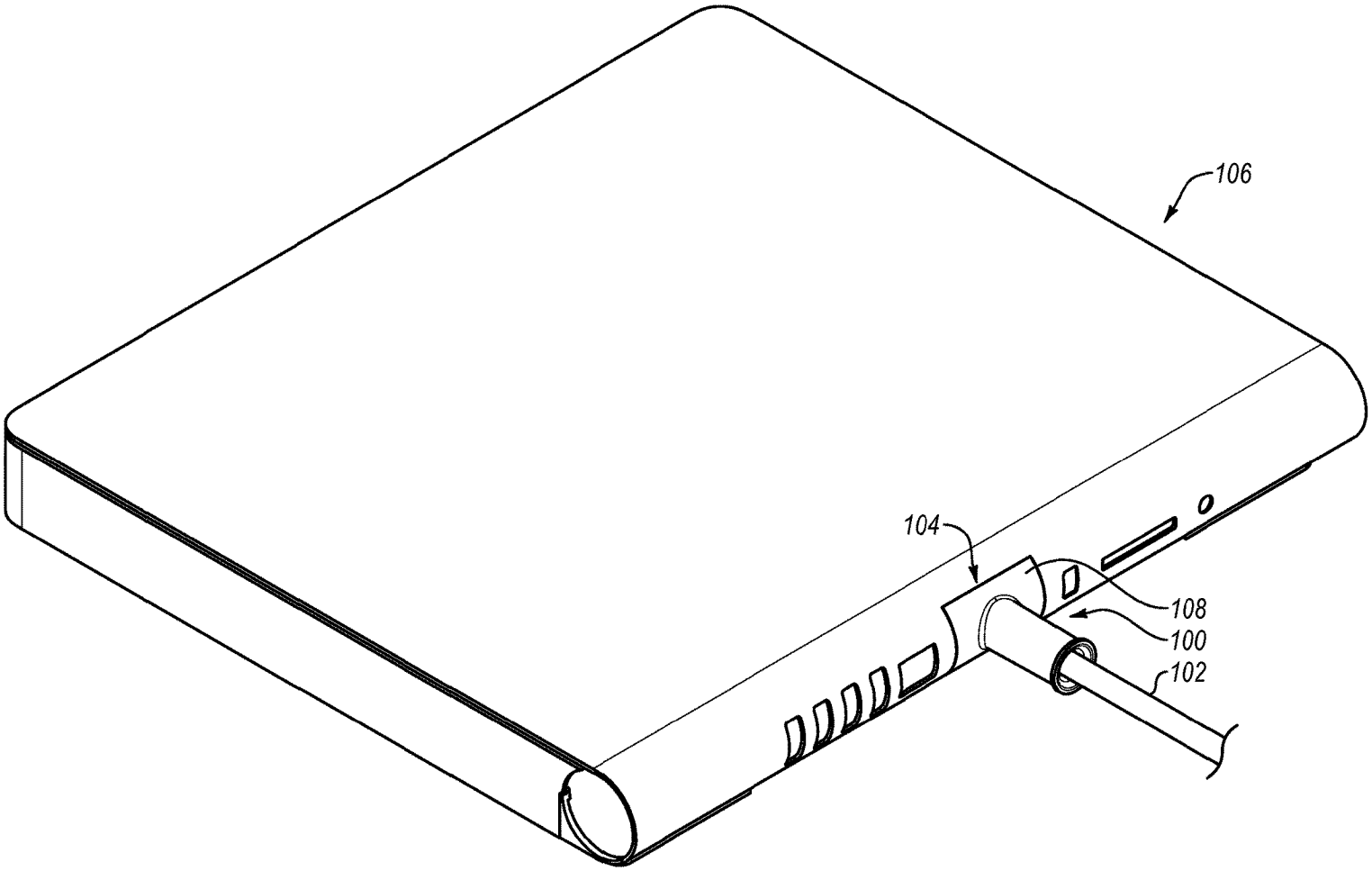
FIG. 1 is a perspective view of an implementation of a system for forming an electrical connection between an electrical connector and an electronic device.

In some implementations, such as shown in FIG. 1, an appliance coupler connector 100 is an end of an electrical cable 102, and the appliance coupler connector 100 connects to an appliance inlet connector 104 on an electronic device 106. For example, the appliance coupler connector 100 may be a C13 plug and the appliance inlet connector 104 may be a C14 plug in accordance with the International Electrotechnical Commission (IEC) 60320 standard. In other examples, the appliance coupler connector 100 and the appliance inlet connector 104 may be other mating pairs of connectors according to the IEC 60320 standard. In yet other examples, the appliance coupler connector and the appliance inlet connector may be a mating pair of connectors according to another standard.

The appliance coupler connector 100 may have an exterior mating surface 108 with a proximal-facing surface configured to mate against or proximate to an appliance inlet connector surface of the appliance inlet connector 104. For example, the proximal-facing surface may be oriented toward the electronic device 106 including the appliance inlet connector 104. In some implementations, the proximal-facing surface may be moveable in an axial direction relative to (e.g., movement away from) the appliance inlet connector 104. The appliance coupler connector 100 includes a biasing element configured to bias the axial position of the proximal-facing surface in the axial direction toward the distal end of the appliance coupler connector 100 (i.e., away from a user when connected to the appliance inlet connector 104). For example, an outer housing or exterior mating surface 108 of the appliance coupler connector 100 may have a predetermined range of axial movement relative to the plug of the appliance coupler connector 100.

The appliance coupler connector 100 may be a locking plug that has a locking mechanism configured to grip, latch, pinch, frictionally engage, or otherwise mechanically resists the axial movement of the locking plug relative to one or more prongs of the plurality of prongs on the appliance inlet connector. In some implementations, the locking mechanism may engage with a prong of the appliance inlet connector 104 to limit and/or prevent the axial movement relative to the appliance inlet connector 104. In other implementations, the locking mechanism may engage with a plurality of prongs of the appliance inlet connector 104.

In some implementations in which the appliance coupler connector 100 includes a locking plug, as described herein, a lock actuator operably coupled to the locking plug to bias the locking plug in a locked position, and a moveable exterior mating surface 108. The movement of the moveable exterior mating surface 108 may move the lock actuator to actuate the lock mechanism and move the locking mechanism to an unlocked state, allowing the disengagement of the appliance coupler connector 100 from the appliance inlet connector 104.

Figure 2A:
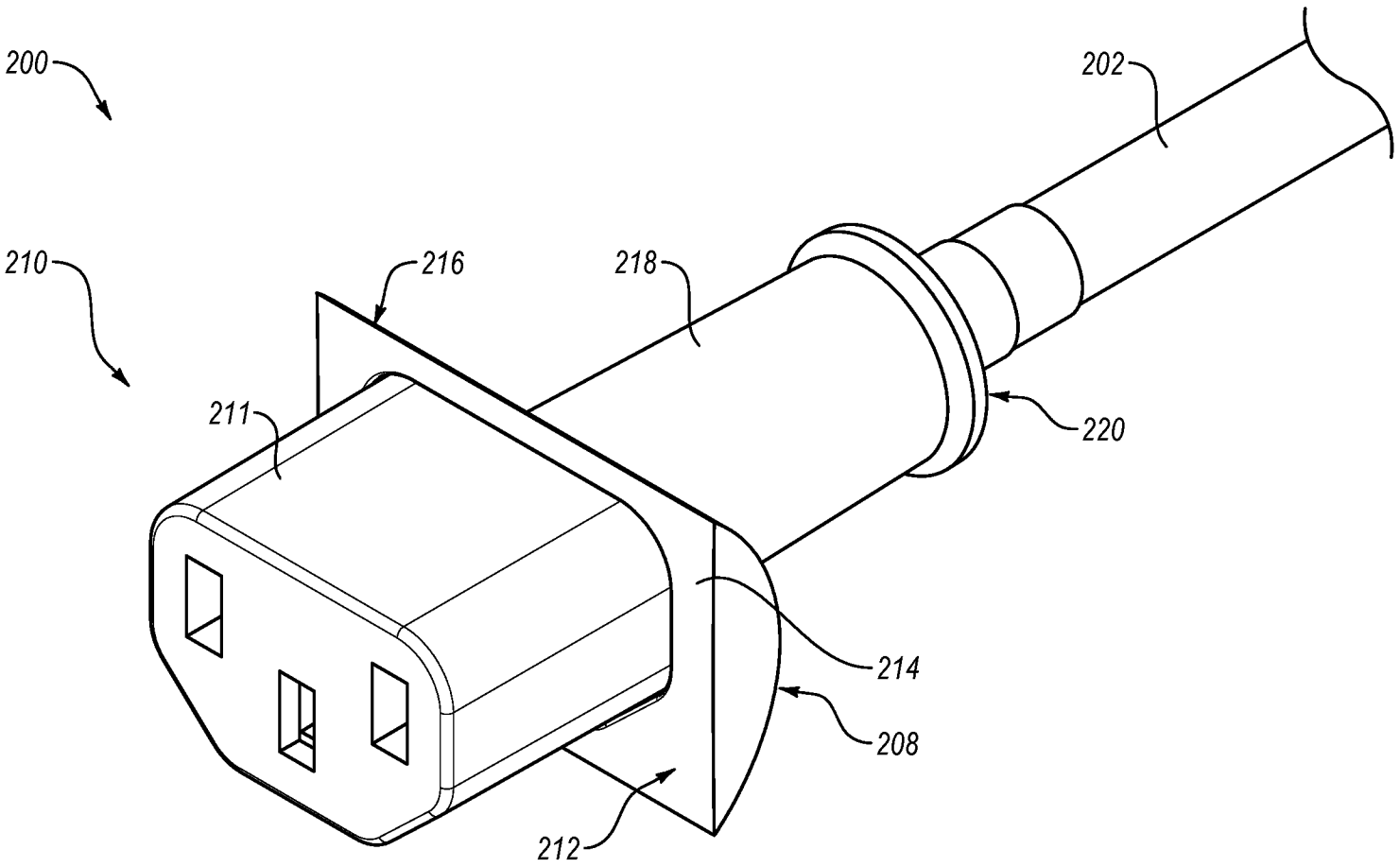
FIG. 2A is a perspective view of an implementation of an electrical connector.

FIG. 2A illustrates an implementation of an appliance coupler connector 200. The appliance coupler connector 200 includes an electrical plug 210 with a cover 211 thereon, an exterior mating surface 208, and a strain relief 220. The cover 211 may enclose one or more components of the electrical plug 210. For example, the lock actuator (such as lock actuator 230 shown in FIG. 2B) may be at least partially internal to (e.g., within) the cover 211. The appliance coupler connector 200 is configured to mate with an appliance inlet connector to provide electrical communication between an electrical cable 202 in electrical communication with the appliance coupler connector 200 and an electronic device in electrical communication with an appliance inlet connector.

The appliance coupler connector 200 has an exterior mating surface 208 that is moveable in an axial direction (i.e. in the direction of a longitudinal axis of the electrical connector). In some implementations, the exterior mating surface 208 has a proximal-facing surface 212 oriented toward the electrical plug 210 with a shoulder 214 extending laterally away from and/or beyond the electrical plug 210. In some implementations, the shoulder 214 is rectangular about the electrical plug 210. In other implementations, at least a portion of the shoulder 214 is elliptical, circular, otherwise round, polygonal, irregular, or combinations thereof.

The shoulder 214 extends laterally away from and beyond the electrical plug by an amount relative to the width of the electrical plug 210. A shoulder ratio is the ratio of the width of the shoulder 214 relative to a width of the electrical plug 210. In some implementations, the shoulder 214 extends laterally away from and beyond the electrical plug 210 by a shoulder ratio in a range having an upper value, a lower value, or upper and lower values including any of 1.0, 1.1, 1.2, 1.3, 1.4, 1.5, 1.6, 1.7, 1.8, 1.9, 2.0, or any values therebetween. For example, the shoulder ratio may be less than 2.0. In other examples, the shoulder ratio is between 1.0 and 2.0. In at least one example, the shoulder ratio is about 1.5. In at least one example, the shoulder ratio may comply with an IEC 60320 specification.

The exterior mating surface 208 may have a distal-facing surface 216 that is oriented in the opposite direction from the proximal-facing surface 212 and toward the cable 202. In some implementations, the distal-facing surface 216 is curved in profile. In other implementations, the distal-facing surface 216 is planar in profile.

In some implementations, a distal projection 218 of the exterior mating surface 208 projects distally from the distal-facing surface 216. The distal projection 218 may flank and/or encircle at least a portion of the cable 202 and/or at least a portion of a strain relief 220 about the cable 202.

Figure 2B:
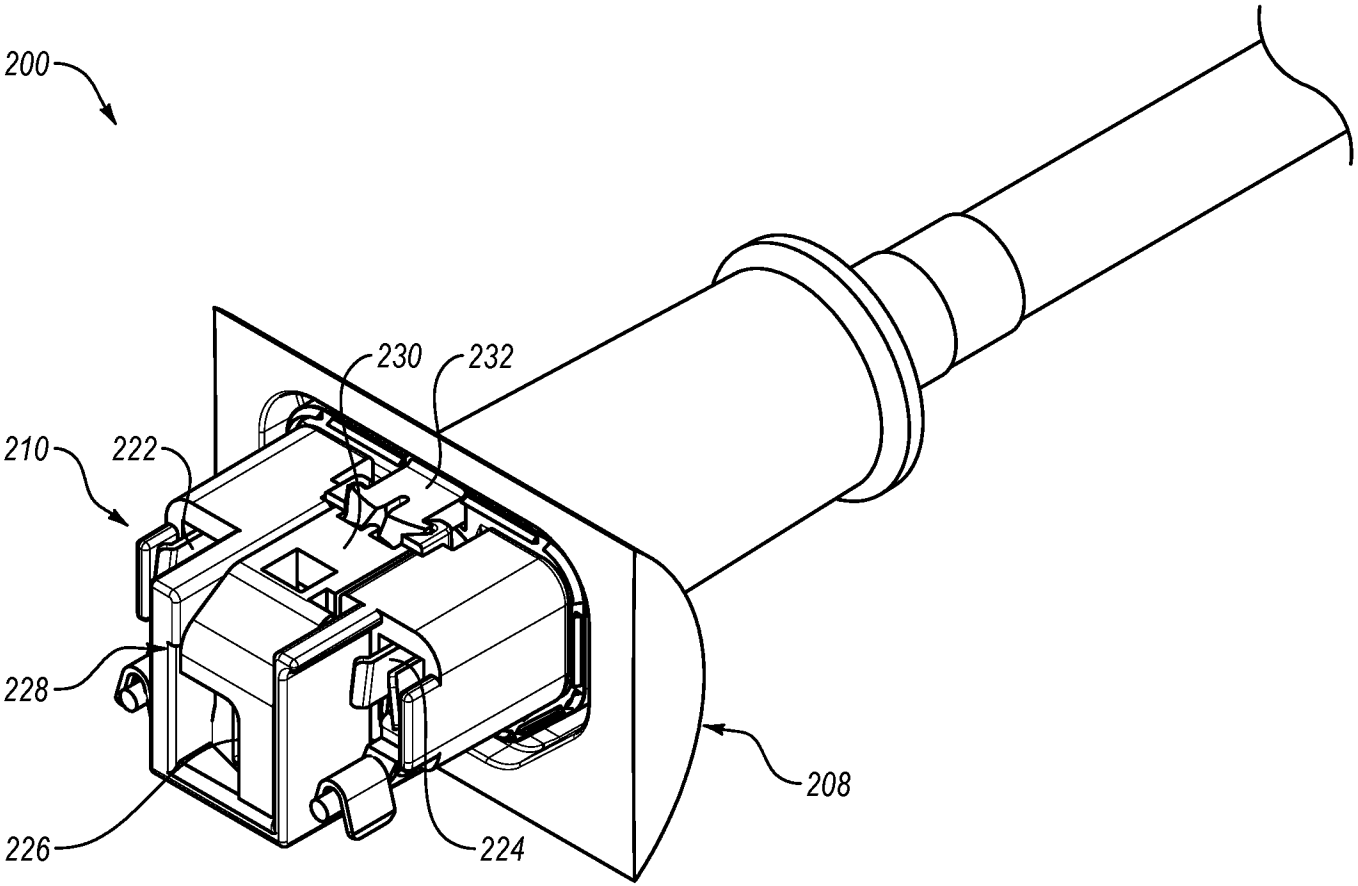
FIG. 2B is a perspective view of the implementation of an electrical connector of FIG. 2A with a cover removed.

Referring now to FIG. 2B, the appliance coupler connector 200 of FIG. 2A is illustrated with the cover of the electrical plug 210 removed. The electrical plug 210 illustrated in FIG. 2B is a locking plug with a positive receiver 222, a negative receiver 224, and a ground receiver 226. The ground receiver 226 has a locking mechanism 228, operably coupled to a lock actuator 230. The lock actuator 230 is connected to a tab 232 of the exterior mating surface 208.

Figure 2C:
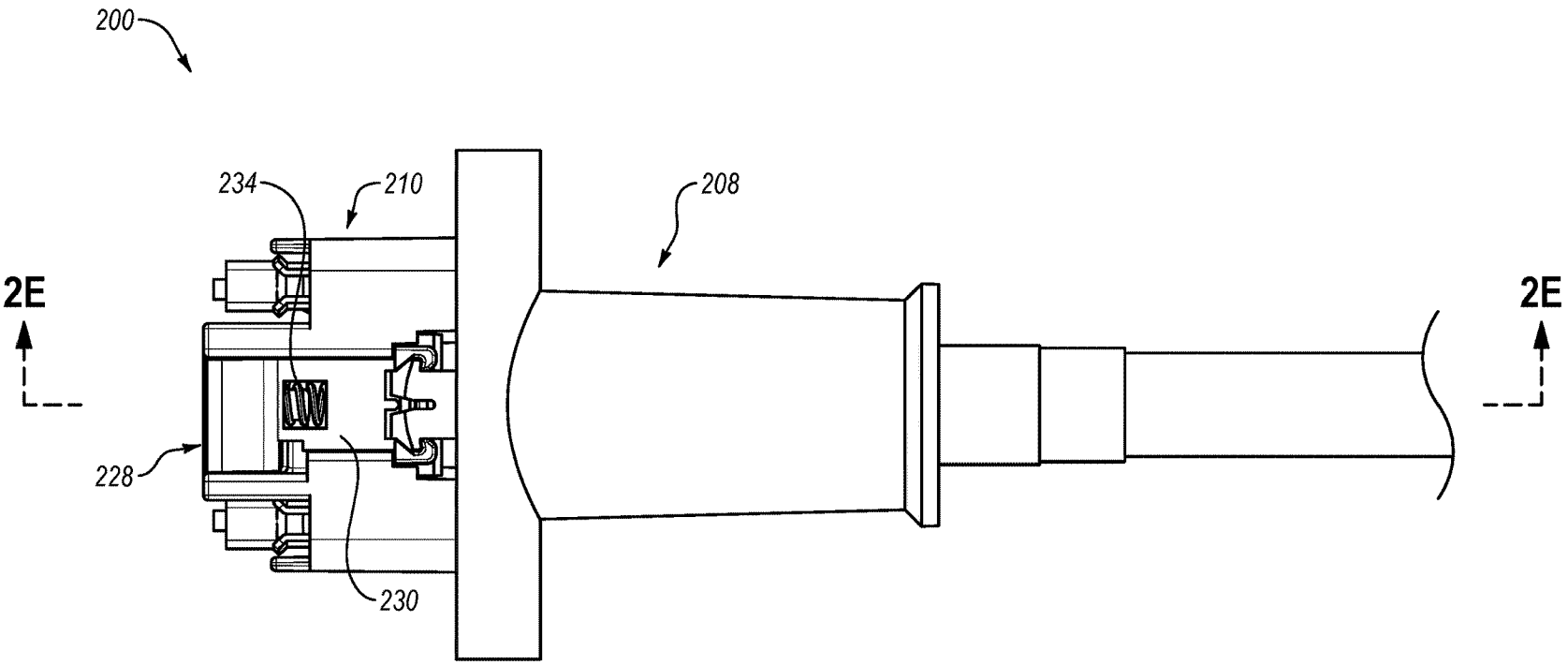
FIG. 2C is a top view of the implementation of an electrical connector of FIG. 2B.

As shown in FIG. 2C, a biasing element may be a spring 234 or other resilient member that biases the locking mechanism 228 and lock actuator 230 in the proximal direction. The exterior mating surface 208 is slidable in an axial direction relative to the electrical plug 210. Distal motion of the exterior mating surface 208 moves the tab 232 in the distal direction away from the electrical plug 210, which, in turn, moves the lock actuator 230 in the distal direction.

In some implementations, the biasing element may apply a biasing force to the lock actuator 230 that is in a range having an upper value, a lower value, or upper and lower values including any of 0.20 Newtons (N), 0.30 N, 0.40N, 0.50 N, 0.60 N, 0.70 N, 0.80 N, 0.90 N, 1.00 N, 1.10 N, 1.20 N, 1.30 N, 1.40 N, 1.50 N, 1.60 N, 1.70 N, 1.80 N, 1.90 N, 2.00 N, of any values therebetween. For example, the biasing force may be greater than 0.20 N. In other examples, the biasing force may be less than 2.00 N. In yet other examples, the biasing force may be between 0.20 N and 2.00 N. In further examples, the biasing force may be between 0.40 N and 1.50 N. In at least one example, the biasing force may be about 0.50 N.

The force applied to the exterior mating surface 208 to actuate the locking mechanism 228 and move the locking mechanism 228 to an unlocked state, therefore may be equal to or greater than the biasing force of the biasing element.

Figure 2D:
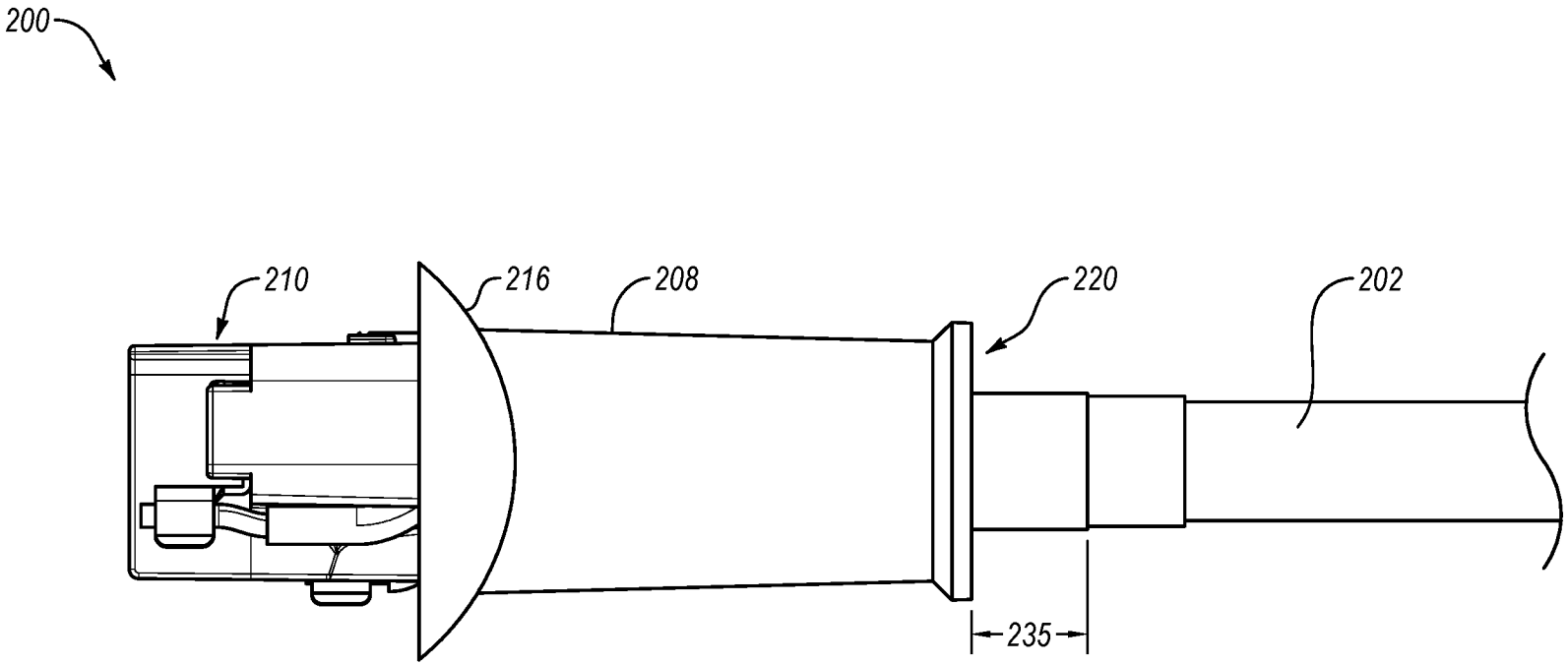
FIG. 2D is a side view of the implementation of an electrical connector of FIG. 2B.

FIG. 2D illustrates a side view of the appliance coupler connector 200. The electrical plug 210, the cable 202, and the strain relief 220 are fixed axially relative to one another, while the exterior mating surface 208 is slidable a predetermined distance 235 in the axial direction. In some implementations, the predetermined distance 235 is in a range having upper values, lower values, or upper and lower values including any of 1 millimeter (mm), 2 mm, 3 mm, 4 mm, 5 mm, 6 mm, 7 mm, 8 mm, 9 mm, 10 mm, or any values therebetween. For example, the predetermined distance 235 may be less than 10 mm. In other examples, the predetermined distance 235 may be greater than 1 mm. In yet other examples, the predetermined distance 235 may be in range from 1 mm to 10 mm. In further examples, the predetermined distance 235 may be in a range of 3 mm to 8 mm. In at least one example, the predetermined distance 235 is about 5 mm.

The distal-facing surface 216 of the exterior mating surface 208 is shown in profile in FIG. 2D. As described herein, the profile of the distal-facing surface 216 may have different shapes including curves, planes, discontinuous angles, or combinations thereof. In some implementations, the distal-facing surface 216 is a continuous curve. For example, the profile of the distal-facing surface 216 may be a circular arc. In other examples, the profile of the distal-facing surface 216 may be an elliptical arc. In some implementations, at least a portion of the distal-facing surface 216 is a curve with a radius of curvature in a range having an upper value, a lower value, or upper and lower values including any of 0.20 inches, 0.30 inches, 0.40 inches, 0.50 inches, 0.60 inches, 0.70 inches, 0.80 inches, 0.90 inches, 1.0 inches, 1.1 inches, 1.2 inches, 1.3 inches, 1.4 inches, 1.5 inches, 1.6 inches, 1.7 inches, 1.8 inches, 1.9 inches, 2.0 inches, or any values therebetween. For example, at least a portion of the distal-facing surface 216 has a radius of curvature greater than 0.20 inches. In other examples, at least a portion of the distal-facing surface 216 has a radius of curvature less than 2.0 inches. In yet other examples, at least a portion of the distal-facing surface 216 has a radius of curvature in a range of 0.20 inches to 2.0 inches. In further examples, at least a portion of the distal-facing surface 216 has a radius of curvature in a range of 0.50 inches to 1.5 inches. In at least one example, at least a portion of the distal-facing surface 216 has a radius of curvature about 1.0 inches.

Figure 2E:
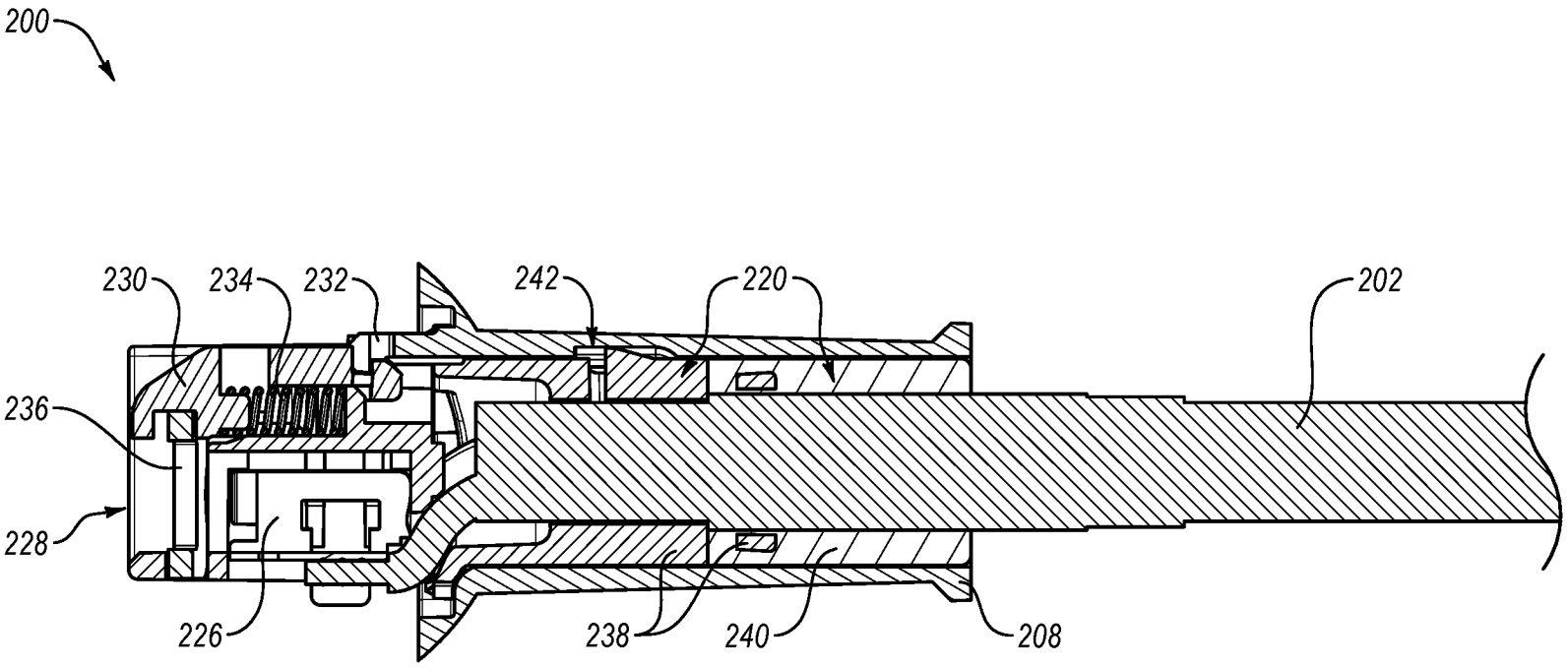
FIG. 2E is a side cross-sectional view of the implementation of an electrical connector of FIG. 2B.

FIG. 2E is a cross-sectional view of the side view of FIG. 2D. The implementation of an appliance coupler connector 200 is depicted with a cross-section through the ground receiver 226 and illustrating the locking mechanism 228. The locking mechanism 228 includes a bracket 236 that may tilt upon application of force by the spring 234, thereby engaging a ground prong. The tilting of the bracket 236 may frictionally engage the bracket 236 with the ground prong, limiting and/or preventing movement of the appliance coupler connector 200 relative to the ground prong, when the appliance coupler connector 200 in coupled to an appliance inlet connector. In other implementations, the locking mechanism 228 may include a protrusion and detent or recess between the locking mechanism 228 and a ground prong that, when engaged, limits and/or prevents movement of the appliance coupler connector 200 relative to the ground prong.

The locking mechanism 228 is shown in the unlocked state in FIG. 2E, with the bracket 236 substantially perpendicular to the axial direction. The spring 234 is compressed in FIG. 2E as the exterior mating surface 208 is moved toward a distal position away from the electrical plug 210. The tab 232 of the exterior mating surface 208 pulls on the lock actuator 230, which compresses the spring 234 and moves the bracket 236 to the substantially perpendicular position shown, positioning the locking mechanism 228 in an unlocked state.

In some implementations, the axial movement of the electrical plug 210 in a distal direction (i.e., unplugging the appliance coupler connector 200) may be limited and/or prevented by the locking mechanism 228 in the absence of external force applied to the exterior mating surface 208. A distal force applied to the exterior mating surface 208 actuates the locking mechanism 228 and allows distal movement of the electrical plug 210. The actuation of the locking mechanism 228 to an unlocked state and the axial movement of the electrical plug 210 may, therefore, be performed in a single motion and/or application of force by a user, rendering the locking mechanism transparent from the perspective of the user's experience.

The lock actuator 230 may be connected to the exterior mating surface 208 in various types of connections. In some implementations, the tab 232 is a hook or other mechanical interlocking feature that engages with an opening, a recess, or other complimentary interlocking feature in the lock actuator 230. In other implementations, the exterior mating surface 208 is connected to the lock actuator 230 by a pin, clip, clamp, or other mechanical fastener. In yet other implementations, the exterior mating surface 208 is connected to the lock actuator 230 by an adhesive. In further implementations, the exterior mating surface 208 is connected to the lock actuator 230 by a combination of interlocking features, fasteners, and adhesives.

As shown in FIG. 2E, the strain relief 220 may include a plurality of portions. For example, the plurality of portions may include portions including or made of different materials. In some implementations, the different materials include a rigid material 238 and a soft material 240 to provide strain relief to the cable 202. For example, the soft material 240 may be distal of the rigid material 238. In other examples, at least a portion of the soft material 240 may longitudinally overlap a portion of the rigid material 238. As shown in FIG. 2E, the soft material 240 and the rigid material 238 may be co-molded to produce a mechanical interlock therebetween to retain the soft material 240 and rigid material 238 relative to one another.

It should be understood that "soft" and "rigid" are relative to one another. For example, the soft material 240 may have a Young's modulus that is less than the rigid material 238.

In some implementations, the soft material 240 has a Young's modulus that is less than 1.0 gigapascals (GPa) and the rigid material 238 has a Young's modulus that is greater than 1.0 GPa. In other implementations, the soft material 240 has a Young's modulus that is less than 0.50 GPa and the rigid material 238 has a Young's modulus that is greater than 0.50 GPa. In yet other implementations, the soft material 240 has a Young's modulus that is less than 0.10 GPa and the rigid material 238 has a Young's modulus that is greater than 0.10 GPa.

The strain relief 220 may be substantially the same longitudinal length as the exterior mating surface 208. In other implementations of an appliance coupler connector 200, a longitudinal length of the exterior mating surface 208 is greater than a longitudinal length of the strain relief 220. In yet other implementations, a longitudinal length of the exterior mating surface 208 is less than a longitudinal length of the strain relief 220.

The axial movement of the exterior mating surface 208 relative to the strain relief 220 (or other portions of the appliance coupler connector 200) may be at least partially constrained by a mechanical interaction of the exterior mating surface 208 and the strain relief 220. For example, the exterior mating surface 208 may include a recess 242 that receives a portion of the strain relief 220. The recess 242 may limit the axial movement of the exterior mating surface 208 relative to the strain relief 220. In some implementations, the recess 242 may also rotationally key the exterior mating surface 208 to the strain relief 220, limiting and/or prevent the rotation of the exterior mating surface 208 relative to the strain relief 220.

Figure 3A:
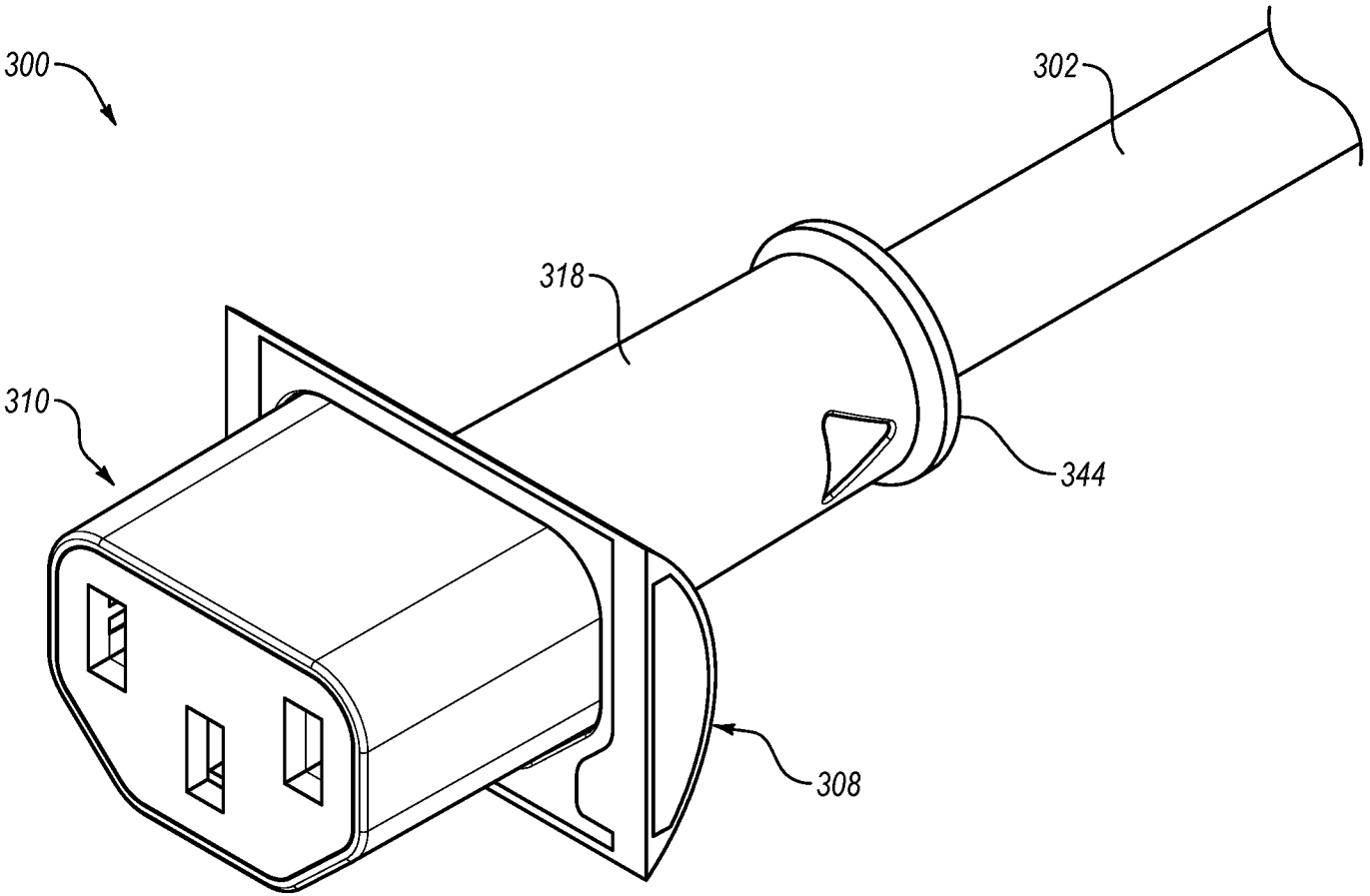
FIG. 3A is a perspective view of an implementation of another electrical connector.

In other implementations of an appliance coupler connector, an exterior mating surface and strain relief may be the same component, may be integrally formed, or may be co-molded such that the strain relief is configured to move axially relative to an electrical plug. FIG. 3A is a perspective view of another implementation of an appliance coupler connector 300 with a cable 302 in electrical communication with an electrical plug 310 and an exterior mating surface 308 that is axially moveable relative to the electrical plug 310 and cable 302.

The exterior mating surface 308 has a distal projection 318 positioned circumferentially about the cable 302. The implementation of a distal projection 318 illustrated in FIG. 3A includes a flare 344 at the distal end to provide strain relief to the cable 302. The flare 344 may reduce the need for a portion of the strain relief to project distally from the exterior mating surface 308.

Figure 3B:
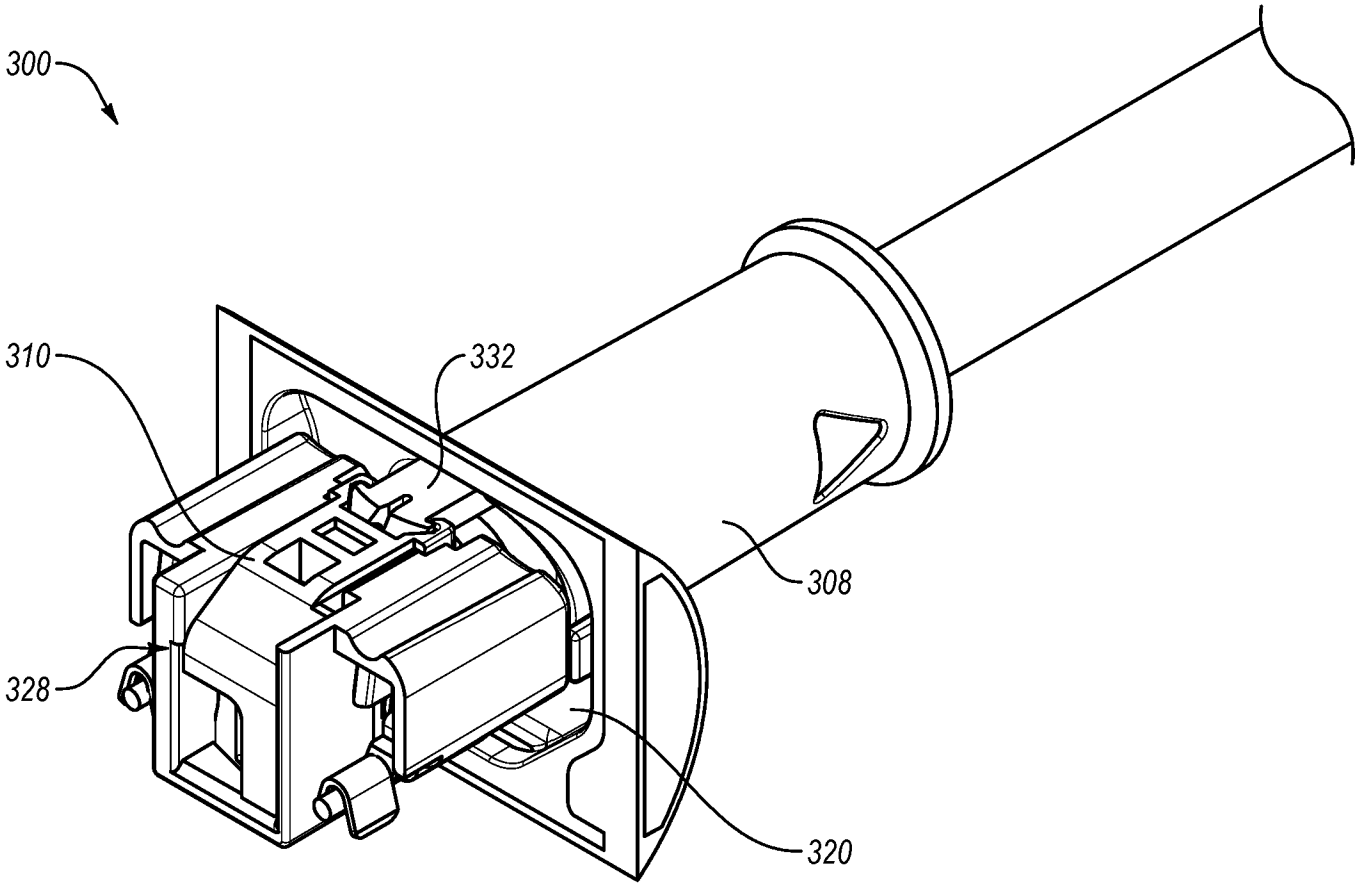
FIG. 3B is a perspective view of the implementation of an electrical connector of FIG. 3A with a cover removed.

As shown in FIG. 3B, the strain relief 320 is co-molded with the exterior mating surface 308 such that the strain relief 320 is not visible from the exterior of the assembled appliance coupler connector 300. With the cover of the electrical plug 310 removed, the strain relief 320 is visible radially within the exterior mating surface 308.

In the depicted implementation, the tab 332 is integrally formed with the strain relief 320. As mentioned herein, the strain relief 320 is moveable in the axial direction with the exterior mating surface 308 such that the tab 332 of the strain relief 320 applies a force to actuate the locking mechanism 328 of the electrical plug 310.

Figure 3C:
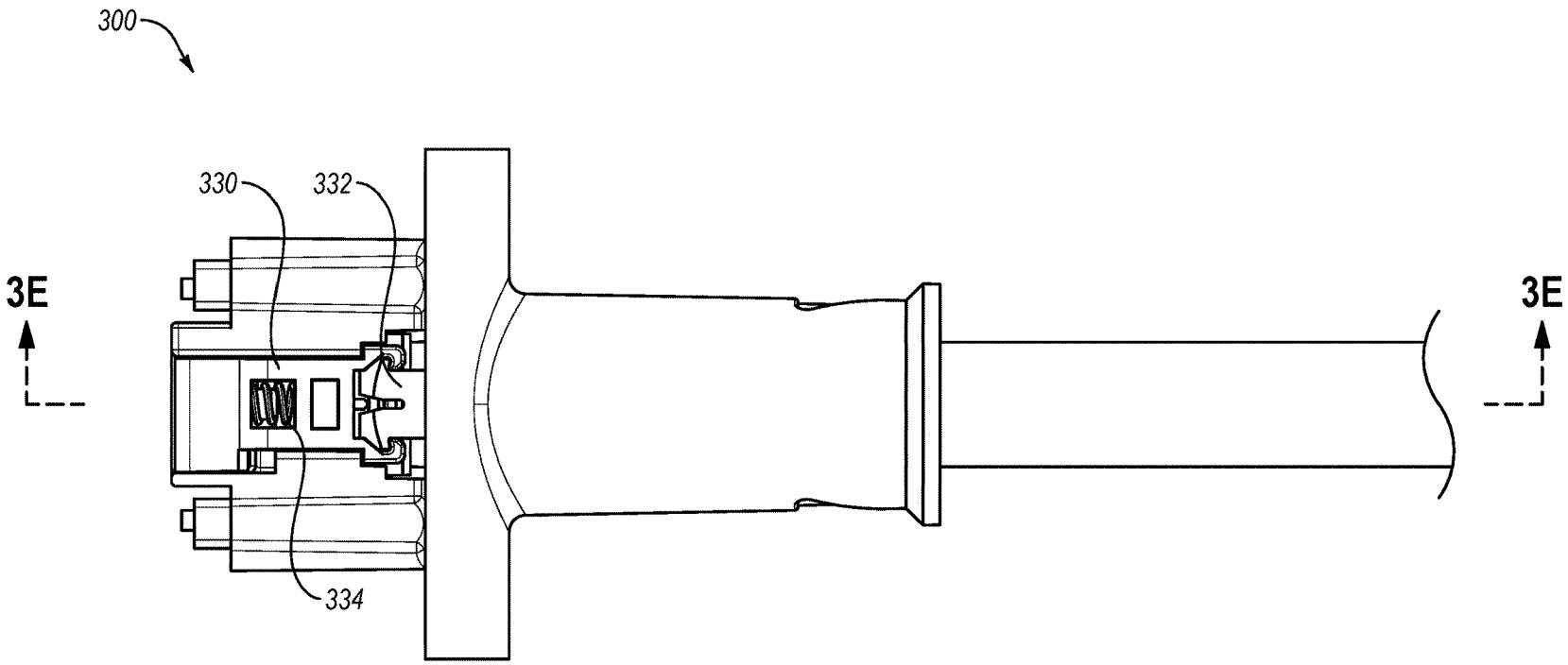
FIG. 3C is a top view of the implementation of an electrical connector of FIG. 3B.

Referring now to FIG. 3C, in some implementations, an axial force is applied against the spring 334 through the tab 332. The tab 332 includes a hook or other mechanical interlocking feature that engages with another hook, an opening, a recess, or other complimentary interlocking feature in the lock actuator 330. In other implementations, the tab 332 is connected to the lock actuator 330 by a pin, clip, clamp, or other mechanical fastener. In yet other implementations, the tab 332 is connected to the lock actuator 330 by an adhesive. In further implementations, the tab 332 is connected to the lock actuator 330 by a combination of interlocking features, fasteners, and adhesives.

Figure 3D:
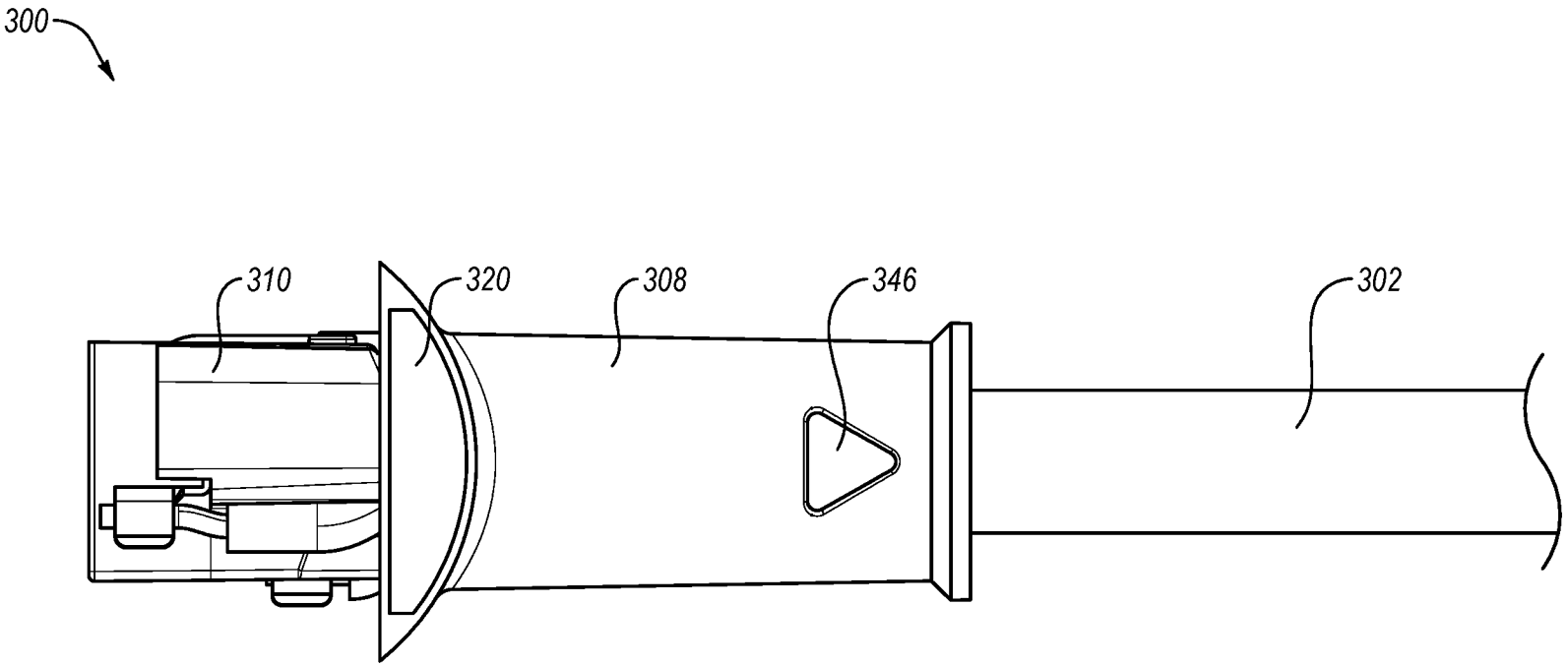
FIG. 3D is a side view of the implementation of an electrical connector of FIG. 3B.

Referring now to FIG. 3D, some implementations of an appliance coupler connector 300 may include one or more grip features 346 on or in the exterior mating surface 308. For example, a grip feature 346 may be a recess in the exterior mating surface 308 that enhances a user's grip of the exterior mating surface 308. In other examples, a grip feature 346 may be a protrusion in the exterior mating surface 308 that enhances a user's grip of the exterior mating surface 308.

In some implementations, a grip feature 346 may visually communicate instructions to a user regarding how to unlock and unplug the electrical plug 310. For example, the grip feature 346 shown in FIG. 3D is an arrow that communicates to a user to grip the exterior mating surface 308 and pull the exterior mating surface 308 in the direction of the arrow, as opposed to simply pulling on the cable 302.

As can be seen in the side view, the exterior mating surface 308 is over-molded on the strain relief 320. In some implementations, the exterior mating surface 308 includes or is made of a soft material and the strain relief 320 includes or is made of a rigid material.

Figure 3E:
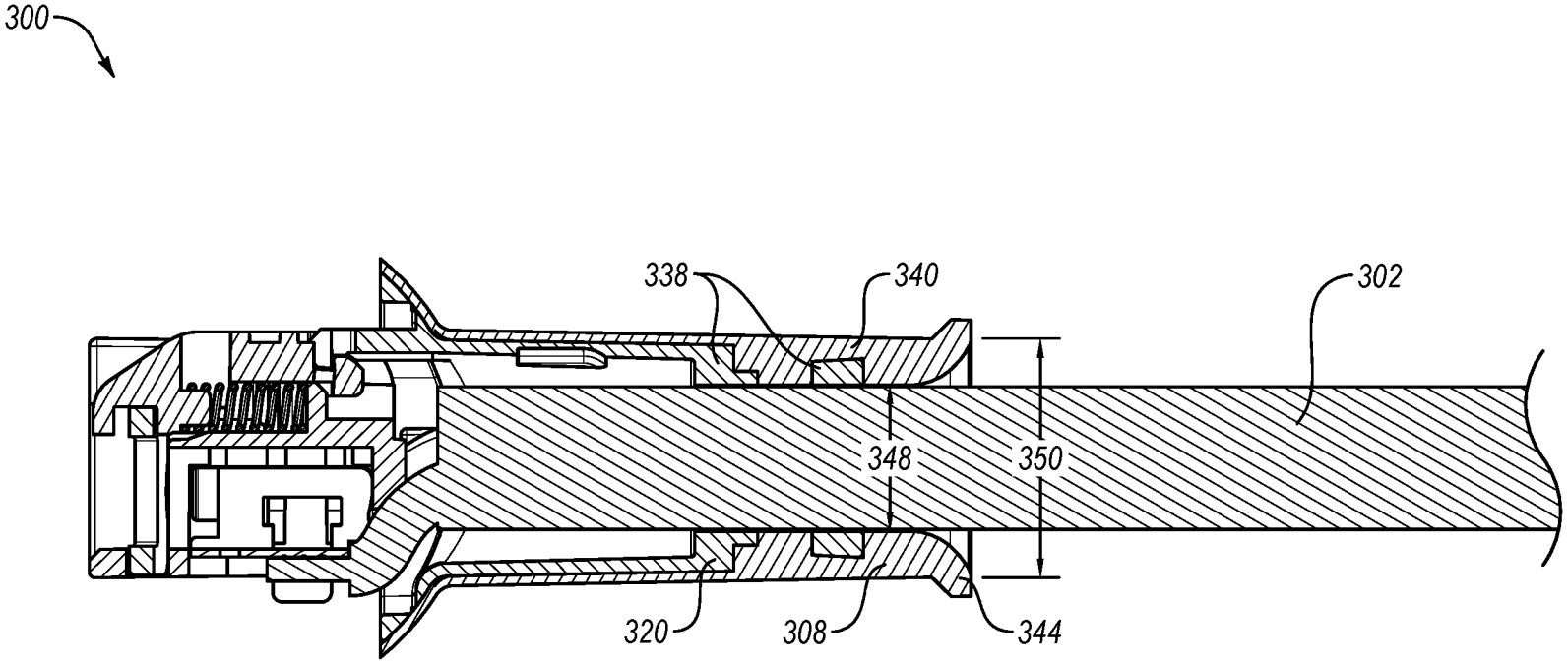
FIG. 3E is a side cross-sectional view of the implementation of an electrical connector of FIG. 3B.

FIG. 3E illustrates a cross-section of the side view of FIG. 3D. The strain relief 320 may be radially within the exterior mating surface 308. The rigid material 338 of the strain relief 320 may have a longitudinal length less than the longitudinal length of the soft material 340 of the exterior mating surface 308. The rigid material 338 of the strain relief 320 may provide radial support to soft material 340 of the exterior mating surface 308. For example, a user may radially compress the soft material 340 manually and thereby increase friction between the moveable exterior mating surface 308 and the cable 302. Compression of the exterior mating surface 308 against the cable 302 may limit and/or prevent the axial movement of the exterior mating surface 308, preventing the unlocking of the locking mechanism.

In some implementations, the coefficient of friction of the soft material 340 may be greater than the rigid material 338. Positioning rigid material 338 or other material with a lower coefficient of friction than the soft material 340 of the exterior mating surface 308 radially within the soft material 340 of the exterior mating surface 308 may ease the axial movement of the exterior mating surface 308.

The exterior mating surface 308 may supplement the strain relief 320 or be the strain relief supporting the cable 302. In some implementations, the exterior mating surface 308 has a flare 344 in which an inner diameter of the exterior mating surface increases to provide a curved surface to guide the flexion of the cable 302 and limit and/or prevent kinking of the cable 302. For example, the exterior mating surface 308 may have an inner diameter 348 and the flare 344 may have a flare diameter 350 that are related through a flare ratio describing the proportion by which the flare 344 increases in diameter (i.e., the flare diameter 350 to the inner diameter 348).

In some implementations, the flare ratio is in a range having an upper value, a lower value, or upper and lower values including any of 1.0, 1.1., 1.2, 1.3, 1.4, 1.5, 1.6, 1.7, 1.8, 1.9, 2.0, or any values therebetween. For example, the flare ratio may be greater than 1.0. In other examples, the flare ratio may be less than 2.0. In yet other examples, the flare ratio may be between 1.0 and 2.0. In further examples, the flare ratio may be between 1.25 and 1.75. In at least one example, the flare ratio may be about 1.5.

Figure 4A:
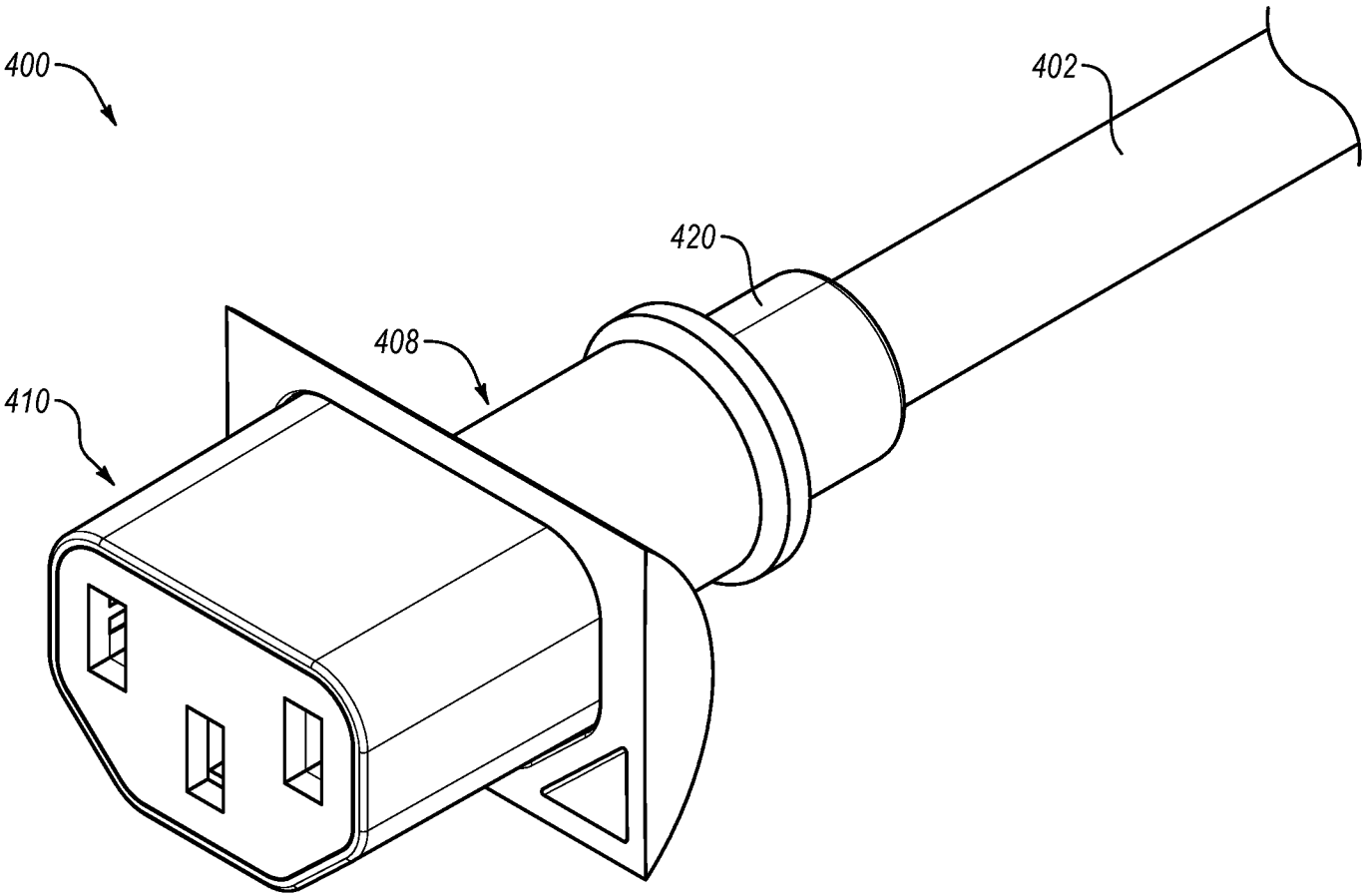
FIG. 4A is a perspective view of an implementation of another electrical connector.

FIG. 4A illustrates yet another implementation of an appliance coupler connector 400. The appliance coupler connector includes an electrical plug 410 in electrical communication with a cable 402 and an axially movable exterior mating surface 408 positioned circumferentially about and axially overlapping a strain relief 420. In the depicted implementation, at least a portion of the strain relief protrudes distally from the exterior mating surface 408.

Figure 4B:
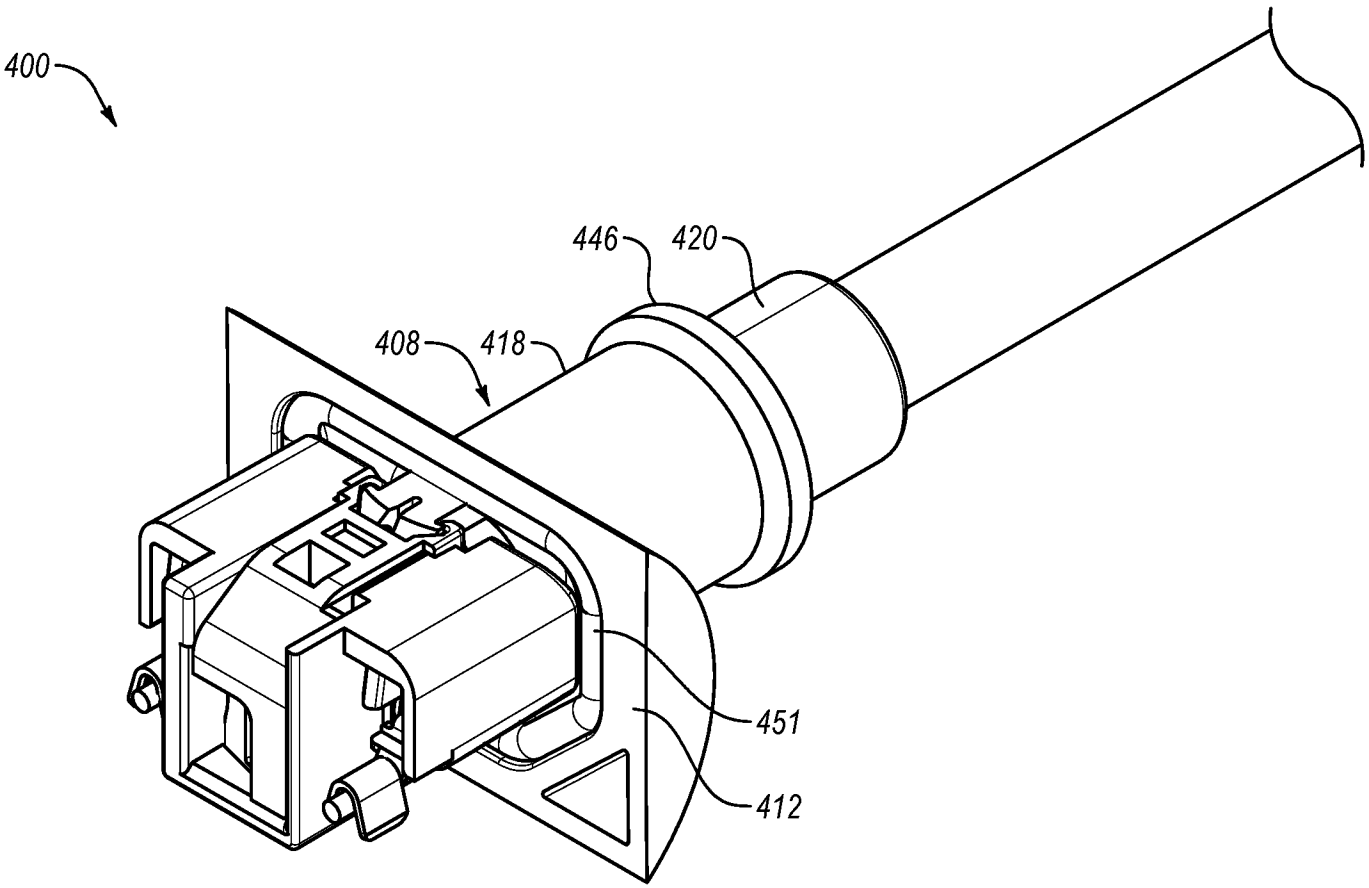
FIG. 4B is a perspective view of the implementation of an electrical connector of FIG. 4A with a cover removed.

FIG. 4B is a perspective view of the implementation of an appliance coupler connector 400 with a gasket 451 on the proximal-facing surface 412 of the exterior mating surface 408. In some implementations, the proximal-direction bias of the biasing element urges the exterior mating surface 408 in a proximal direction with a sufficient force to provide a seal against an electronic device or other device with an appliance inlet connector. For example, the gasket 451 may be an O-ring that is moved and compressed proximally by the exterior mating surface 408 to form a seal. The seal may reduce or prevent the entry of liquids, dust, or other materials potentially harmful to an electrical connection from entering the electrical connection.

In implementations where the strain relief 420 protrudes distally from the exterior mating surface 408, a distal projection 418 of the exterior mating surface 408 may include a grip feature 446, such as a ridge or other tactilely identifiable feature to allow tactile identification of the distal end of the exterior mating surface 408 and improve a user's grip on the exterior mating surface 408. For example, a user reaching behind an electronic device and pulling on the strain relief 420 mistaking the strain relief 420 for the exterior mating surface 408 may damage the strain relief 420.

Figure 4C:
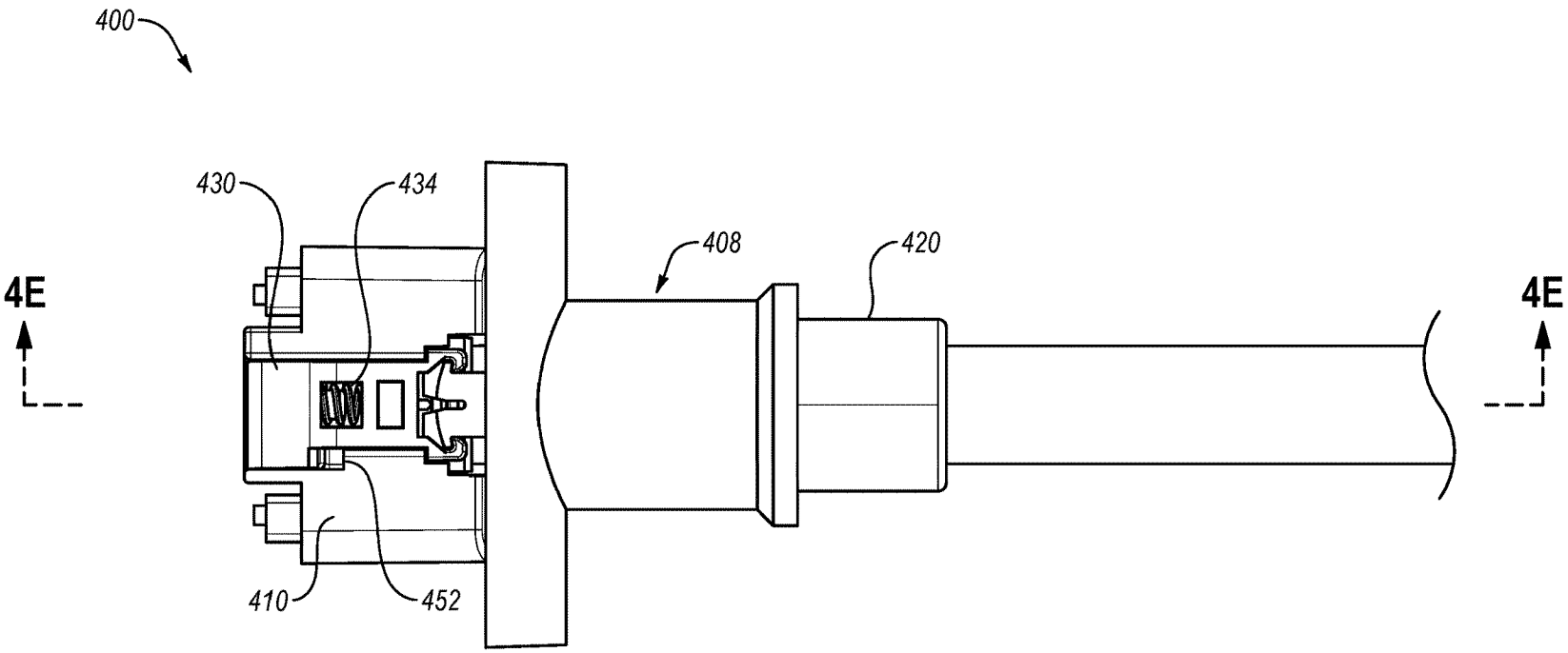
FIG. 4C is a top view of the implementation of an electrical connector of FIG. 4B.

Referring now to FIG. 4C, the distal axial movement of the exterior mating surface 408 relative to the strain relief 420 and electrical plug 410 may be limited by the axial movement of the lock actuator 430. For example, the lock actuator 430 is biased in the proximal direction by a spring 434 of other biasing element and the distal movement of the exterior mating surface 408 may act against the spring 434 to move the lock actuator 430 distally. The distal axial movement of the lock actuator 430 may be limited by an interaction with a stop 452 on or in the electrical plug 410. In such implementations, the predetermined distance (e.g., distance 235 described in relation to FIG. 2D) that the exterior mating surface 408 may move in the axial direction is limited by the distance the lock actuator 430 may move axially before contacting the stop 452 of the electrical plug 410.

Figure 4D:
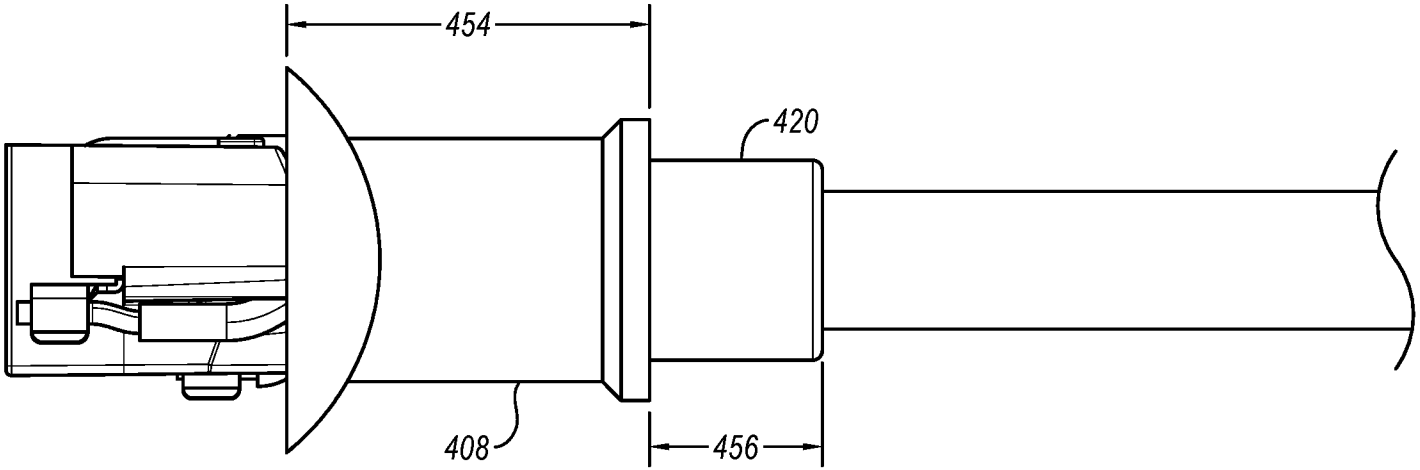
FIG. 4D is a side view of the implementation of an electrical connector of FIG. 4B.

In some implementations, the strain relief 420 may protrude distally from the exterior mating surface 408 by an amount related to the longitudinal length of the exterior mating surface 408. As shown in FIG. 4D, the exterior mating surface 408 has an exterior mating surface length 454. A protrusion length 456 of the strain relief 420 may be related to the exterior mating surface length 454 by a protrusion ratio. In some implementations, the protrusion ratio (protrusion length 456 to exterior mating surface length 454) is in a range having an upper value, a lower value, or upper and lower values including any of 0.5, 0.6, 0.7, 0.8, 0.9, 1.0, 1.1, 1.2, 1.3, 1.4, 1.5, or any values therebetween. For example, the protrusion ratio may be greater than 0.5. In other examples, the protrusion ratio may be less than 1.5. In yet other examples, the protrusion ratio may be between 0.5 and 1.5. In further examples, the protrusion ratio may be between 0.7 and 1.3. In at least one example, the protrusion ratio is about 1.0.

Figure 4E:
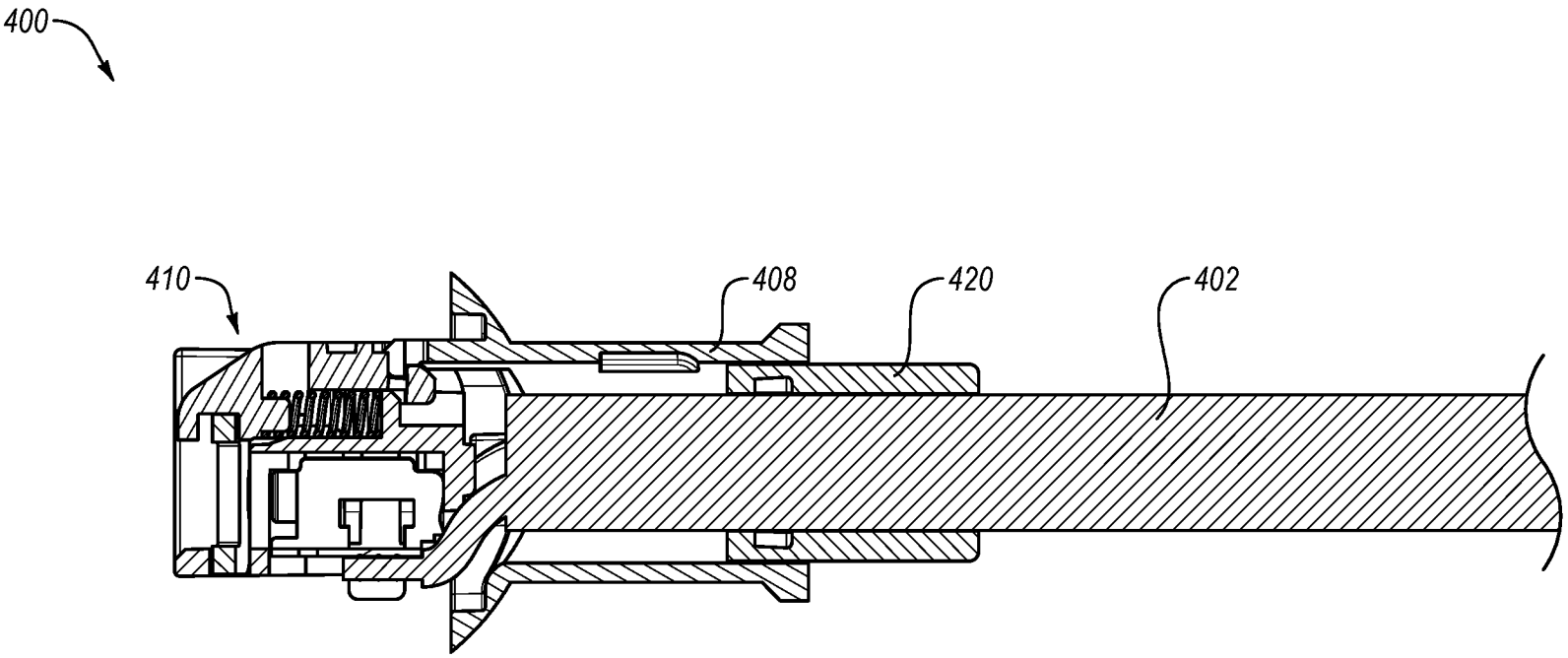
FIG. 4E is a side cross-sectional view of the implementation of an electrical connector of FIG. 4B.

Referring now to FIG. 4E, the appliance coupler connector 400 is shown in side cross-sectional view. The strain relief 420 may be positioned radially within the exterior mating surface 408. At least a portion of the exterior mating surface 408 may not longitudinally overlap the strain relief 420. For example, and as shown in FIG. 4E, the strain relief 420 protrudes distally from the exterior mating surface 408 and is longitudinally displaced from the electrical plug 410. In such implementations, the strain relief 420 may be longitudinally fixed relative to the cable 402 or longitudinally fixed relative to the exterior mating surface 408.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one implementation" or "an implementation" of the present disclosure are not intended to be interpreted as excluding the existence of additional implementations that also incorporate the recited features. For example, any element described in relation to an implementation herein may be combinable with any element of any other implementation described herein. Numbers, percentages, ratios, or other values stated herein are intended to include that value, and also other values that are "about" or "approximately" the stated value, as would be appreciated by one of ordinary skill in the art encompassed by implementations of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to implementations disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the implementations that falls within the meaning and scope of the claims is to be embraced by the claims.

It should be understood that any directions or reference frames in the preceding description are merely relative directions or movements. For example, any references to "front" and "back" or "top" and "bottom" or "left" and "right" are merely descriptive of the relative position or movement of the related elements.

The present disclosure may be embodied in other specific forms without departing from its spirit or characteristics. The described implementations are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. An electrical connector, the electrical connector comprising:

a locking plug with a locking mechanism;

a lock actuator coupled to the locking mechanism;

a strain relief coupled to the locking plug; and an exterior mating surface coupled to the locking plug and axially moveable relative to the locking plug to move the lock actuator, the exterior mating surface being connected to the lock actuator, where movement of the exterior mating surface relative to the locking plug actuates the lock actuator.

2. The electrical connector of claim 1, wherein the strain relief is configured to actuate the lock actuator through an axial force applied to the strain relief by the exterior mating surface.

3. The electrical connector of claim 1, wherein an axial force to actuate the lock actuator is greater than 0.20 Newtons.

4. The electrical connector of claim 3, wherein an axial force to actuate the lock actuator is less than 2.00 Newtons.

5. The electrical connector of claim 1, wherein the exterior mating surface is configured to actuate the lock actuator through an axial force applied to the exterior mating surface.

6. The electrical connector of claim 1, wherein the strain relief includes a rigid material and a soft material.

7. The electrical connector of claim 6, wherein the soft material has a Young's modulus of less than 1 GPa.

8. The electrical connector of claim 6, wherein the rigid material has a Young's modulus of greater than 1 GPa.

9. The electrical connector of claim 1, wherein the exterior mating surface is positioned circumferentially about the strain relief, and the strain relief is coaxial with a cable in electrical communication with the locking plug.

10. The electrical connector of claim 1, wherein the exterior mating surface includes a soft material, the soft material having a Young's modulus of less than 1 GPa.

11. An electrical connector, the electrical connector comprising:

a locking plug with a locking mechanism;

a lock actuator coupled to the locking mechanism;

a cable in electrical communication with the locking plug;

an exterior mating surface coupled to the locking plug and axially moveable relative to the locking plug, the exterior mating surface being connected to the lock actuator, where movement of the exterior mating surface relative to the locking plug actuates the lock actuator;

a biasing element configured to bias the exterior mating surface axially toward the locking plug; and a strain relief positioned circumferentially about the cable.

12. The electrical connector of claim 11, wherein the exterior mating surface is configured to actuate the lock actuator though an axial force applied to the exterior mating surface.

13. The electrical connector of claim 11, wherein the strain relief is moveable relative to the locking plug and the biasing element biases the strain relief toward the locking plug.

14. The electrical connector of claim 11, wherein the exterior mating surface has a shoulder that extends laterally from a longitudinal axis of the exterior mating surface.

15. The electrical connector of claim 14, further comprising a gasket positioned on a proximal-facing surface of the shoulder.

16. The electrical connector of claim 14, wherein the shoulder extends laterally past the perimeter of the plug by between 1 and 2.0 times the width of the plug.

17. A system, the system comprising:

an electronic device having an appliance inlet connector, the appliance inlet connector having an appliance inlet connector surface; and an appliance coupler connector configured to engage with the appliance inlet connector, the appliance coupler connector including:

a locking plug with a locking mechanism, a lock actuator coupled to the locking mechanism;

a strain relief coupled to the locking plug, and an exterior mating surface coupled to the locking plug and axially moveable relative to the locking plug to move the lock actuator, the exterior mating surface being biased toward the appliance inlet connector surface, the exterior mating surface having a shoulder abutting the appliance inlet connector surface in a plugged configuration.

18. The system of claim 17, wherein the appliance coupler connector is an IEC C13 plug, and the appliance inlet connector is an IEC C14 socket.

19. The system of claim 17, wherein the exterior mating surface is positioned circumferentially about the strain relief, and the strain relief is coaxial with the cable in electrical communication with the locking plug.

20. The system of claim 17, wherein a distal facing surface of the exterior mating surface is shaped to match a profile of an exterior surface of the electronic device.

* * * * *